US006152098A

United States Patent [19]

Becker et al.

[11] Patent Number: 6,152,098

[45] Date of Patent: Nov. 28, 2000

[54] INTERNAL COMBUSTION ENGINE FOR A PORTABLE HANDHELD WORK APPARATUS

[75] Inventors: Georg Becker, Schwaikheim; Jürgen Häberlein, Murrhardt; Markus Hüsges, Bergen/Lehnenberg, all of Germany

[73] Assignee: Andreas Stihl AG & Co., Waiblingen, Germany

[21] Appl. No.: 09/229,971

[22] Filed: Jan. 14, 1999

[30] Foreign Application Priority Data

Jan. 14, 1998 [DE] Germany ..... 198 00 904

[51] Int. Cl.[7] ..... F01M 1/00

[52] U.S. Cl. ..... 123/196 R; 126/196 M; 126/90.33

[58] Field of Search ..... 123/196 R, 196 W, 123/196 M, 90.33, 90.38; 184/6.5, 6.9

[56] References Cited

U.S. PATENT DOCUMENTS 5,176,116 1/1993 Imagawa et al. ..... 123/196 W
5,857,441 1/1999 Yonezawa et al. ..... 123/196 R
5,950,590 9/1999 Everts et al. ..... 123/90.33
5,960,764 10/1999 Araki ..... 123/196 M

*Primary Examiner*—John Kwon
*Attorney, Agent, or Firm*—Walter Ottesen

[57] ABSTRACT

The invention is directed to an internal combustion engine for a portable handheld work apparatus. The engine includes a cylinder having a combustion chamber and a piston rotates a crankshaft via a connecting rod. The crankshaft is mounted in a crankcase and is connected to a cam drive. The cam drive drives a valve control for an inlet valve and an outlet valve. The inlet valve controls an overflow channel which leads from the crankcase to the combustion chamber, and the outlet valve controls an outlet channel branching away from the combustion chamber. Furthermore, an intake channel, which opens into the crankcase, and a housing, which is separate from the crankcase, are provided for the cam drive. In order to provide a lubrication for the cam drive which is independent of position, the cam drive is configured as a gear wheel drive and an oil sump is provided in the housing of the cam drive. At least one gear wheel of the cam drive is so arranged that it dips at least partially into the oil sump and pumps oil for lubricating the movable parts of the engine.

28 Claims, 6 Drawing Sheets

INTERNAL COMBUSTION ENGINE FOR A PORTABLE HANDHELD WORK APPARATUS

BACKGROUND OF THE INVENTION

Mostly two-stroke engines are used as a drive in motor-driven chain saws, cutoff machines, brushcutters or the like. Disadvantages are associated with theses engines which result from the mode of operation thereof. Even though the technical development has made significant advances, the exhaust-gas quality of a two-stroke engine can hardly be increased because of the port control.

It is known to provide inlet and outlet valves in two-stroke engines and to actuate these valves via a suitable cam drive and a corresponding valve control. Especially for portable handheld work apparatus, problems result with respect to the necessary lubrication of the cam drive and the valve control because the internal combustion engine must be operationally reliable independent of position. For this reason, a rotation lubrication is therefore hardly suitable and is not justified because of the great complexity. It is especially important with portable handheld work apparatus that technical improvement should not lead to excessive weight because this would limit the use of the apparatus.

SUMMARY OF THE INVENTION

It is an object of the invention to improve an internal combustion engine of the kind referred to above so that a lubrication independent of position is ensured for the valve drive as well as for all moveable engine parts.

The internal combustion engine of the invention is for a portable handheld work apparatus. The internal combustion engine includes: an engine housing including a cylinder and a crankcase; a piston disposed in the cylinder so as to be movable upwardly and downwardly; the cylinder defining a combustion chamber delimited by the piston; the engine housing including an overflow channel leading from the crankcase into the combustion chamber and an outlet channel branching off of the combustion chamber; a crankshaft rotatably journalled in the crankcase; a connecting rod interconnecting the piston and the crankshaft so as to permit the piston to rotate the crankshaft; an inlet valve for controlling the overflow channel and an outlet valve for controlling the outlet channel; a valve control for controlling the opening and closing of the inlet and outlet valves; a cam drive housing separate from the crankcase and defining an oil sump containing lubricating oil; a cam drive for driving the valve control and the cam drive being a gear-wheel drive mounted in the cam drive housing; and, the gear-wheel drive including a plurality of gear wheels and at least one of the gear wheels being mounted in the cam drive housing so as to at least partially dip into the oil sump thereby moving oil to lubricate the cam drive as well as the movable parts of the engine including the valve control.

A gear-wheel drive is provided as a cam drive such that an oil sump coacts with at least one gear wheel of the cam drive in such a manner that oil is pumped to lubricate the cam drive itself and the movable parts of the engine. The oil sump is provided in the housing of the cam drive. This can easily be realized by an appropriate configuration of the housing of the cam drive because, for an appropriate housing configuration, the oil sump is in the region of at least one gear wheel in the cam drive housing in every position of the engine and the gear wheel of the cam drive pumps oil from the oil sump. The housing of the cam drive is separate from the cam housing.

Preferably, the gear wheel, which dips into the oil sump, forms a mist of the oil pumped from the oil sump. A lubrication channel branches off from a region of the cam drive housing above the oil level of the oil sump and opens into the crankcase. This region of the cam drive housing is enriched with the generated oil mist. An adequate supply of oil to the crankcase is guaranteed via such a lubrication channel so that the lubrication of the crankshaft, piston rod and piston is ensured.

The lubrication channel is preferably a line which projects into the region of the cam drive housing which is enriched with oil mist so that its opening lies in the cam drive housing in spaced relationship on all sides thereof. The line purposefully connects to a point in the crankcase which is approximately the lowest point in the rest position or normal position of the engine so that, if necessary, oil, which settles in the crankcase, can be returned via the lubrication channel into the housing of the cam drive.

In another embodiment of the invention, a lubrication channel can be formed by a bore in the crankshaft for generating an oil mist. This bore opens on an axial end of the crank web. Oil flowing through the bore in the crankshaft to the crankcase will exit at the axial end of the crank web and become distributed over the end face because of the effective centrifugal forces and will be thrown off in fine droplets whereby a lubrication of all moveable parts of the engine is achieved in accordance with the oil mist principle.

It can be purposeful to forcibly control the lubrication channel. Thus, the end of the lubrication channel, which faces toward the cam drive housing can coact with a valve member configured in the manner of a rotary slide valve. This valve member is moved by the cam drive. From the construction, it can be pregiven in which positions of the piston (that is, at which pressure ratios in the crankcase) the lubrication channel is opened and closed.

The gear-wheel drive is preferably formed of three gear wheels in order to ensure a rotational direction of the cam for the valve control which is in the same rotational direction. The gear wheels can, for example, be made of plastic to reduce running noise. This plastic can, for example, be nylon or a fiber-reinforced plastic.

A reduced axial structural length of the cam drive is achieved when the center gear wheel meshes with the drive wheel of the camshaft as well as with the drive wheel of the cam via only one set of gear teeth. This increases the load on the center gear wheel and this increased load can be compensated by a corresponding selection of a material. Preferably, the center gear wheel is to be configured with two sets of teeth whereby each set of teeth meshes with an assigned gear wheel. Preferably, the sets of teeth have different diameters.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
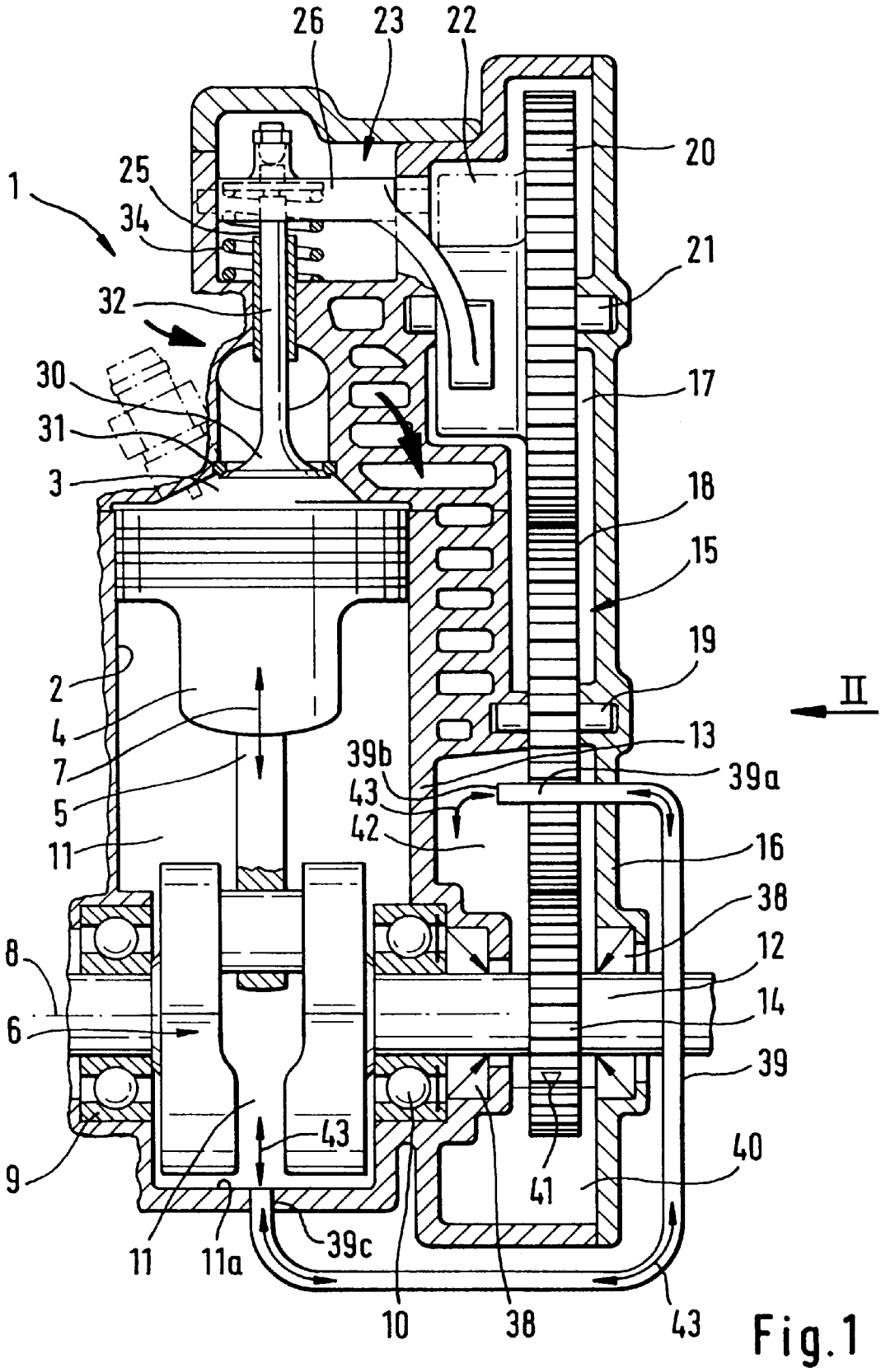
FIG. 1 is a schematic detail view taken through an internal combustion engine for a portable handheld work apparatus.
Figure 2:
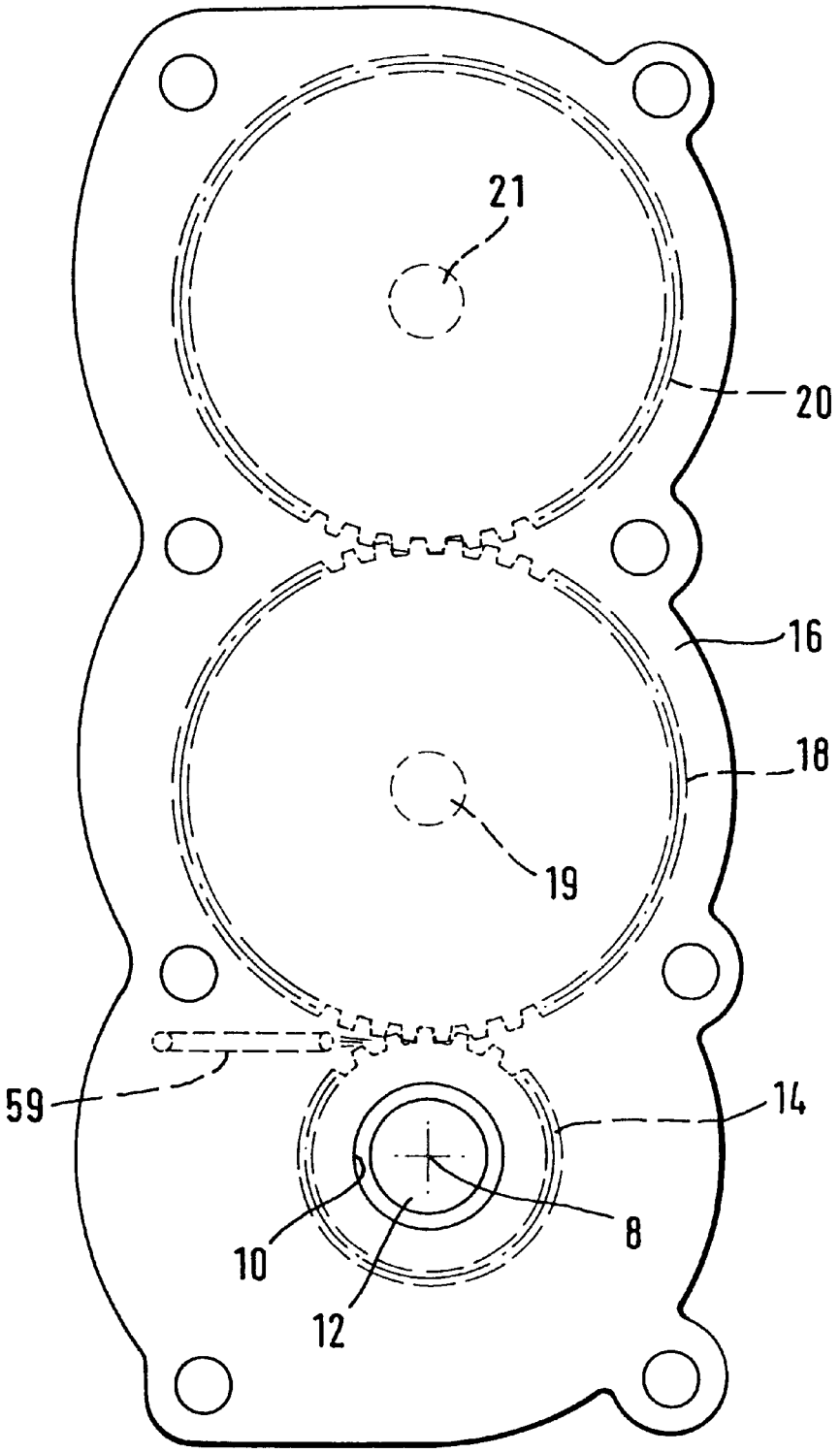
FIG. 2 is a view onto the housing cover of the cam drive housing seen in the direction of arrow II of FIG. 1.

The internal combustion engine 1, which is schematically shown in FIGS. 1 and 2, comprises a cylinder 2 having a combustion chamber 3 which is delimited by a piston 4 movable up and down in the cylinder 2. The piston 4 is connected to a crankshaft 6 via a connecting rod 5 so that the crankshaft 6 rotates about its axis 8 with a piston which is moved up and down in the direction of double arrows 7. The crankshaft 6 is held in crankshaft bearings 9 and 10 which are mounted in the walls of the crankcase 11.

In the embodiment shown, the crankshaft 6 projects at one end 12 through a crankcase wall 13 and carries a drive gear wheel 14 of a cam drive 15. The end 12 of the crankshaft 6 further projects through a housing cover 16 of a cam drive housing 17 in order to drive, as a drive shaft, a tool or the like.

The cam drive 15 comprises a toothed-wheel gearing having preferably three gear wheels 14, 18 and 20. The gear wheels 18 and 20 are preferably rotatably held by bearing pins 19 and 21 in mutually opposite walls of the cam drive housing 17. In the embodiment of FIG. 1, the center gear wheel 18 meshes, on diametrically opposite lying ends, with a drive gear wheel 14, on the one hand, and with an output gear wheel 20 on the other hand. The output gear wheel 20 is preferably provided with a cam 22 on the end thereof facing toward the cylinder 2. Preferably, the cam 22 is configured as one piece with the gear wheel 20. The drive gear wheel 14, the center gear wheel 18 and/or the output gear wheel 20 usually are made of plastic and preferably nylon or a fiber-reinforced plastic. The output gear wheel 20 is formed as one piece with the cam 22.

Figure 7:
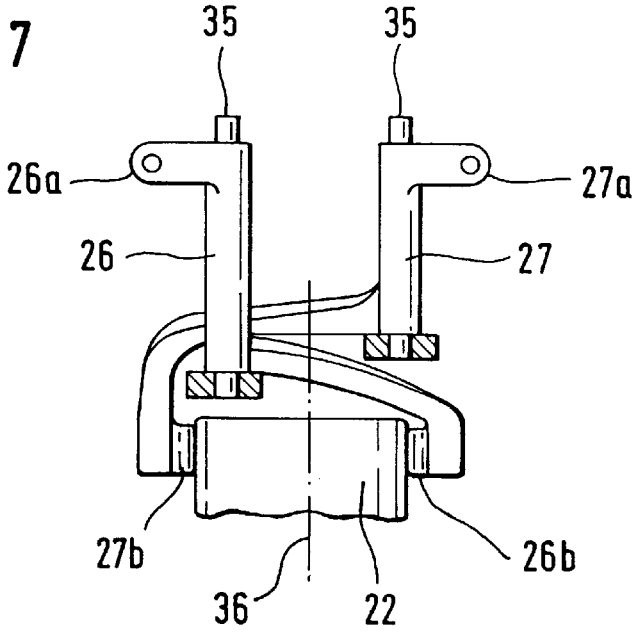

The inlet valve 24 is arranged in the cylinder head 2*a* and the outlet valve 25 is also arranged there. The inlet valve 24 and the outlet valve 25 are actuated together via valve levers (26, 27) by the control cam 22 connected to the gear wheel 20 so as to rotate therewith. The valve lever is shown in FIG. 7. The inlet valve 24 closes the opening of an inlet channel 28 to the combustion chamber 3; whereas, the outlet valve 25 closes the opening of the outlet channel 29 from the combustion chamber 3. Inlet and outlet valves 24 and 25 are configured the same and each comprise a valve plate 30 which lies tightly against a valve seat ring 31 in the rest position. The valve seat ring 31 is pressed into the cylinder head 2*a*.

The valve plate 30 is mounted at the one end of a valve shaft 32 and the other end of this valve shaft carries a spring plate 33. A valve spring 34 lies against the spring plate and holds the spring plate against the valve seat ring 31 in the rest position shown under the spring force. The valve spring 34 is braced on the cylinder head 2*a*.

The valve levers 26 and 27 are configured to have a Z-shape. As shown in FIG. 1, the valve levers 26 and 27 lie with the shorter lever arms 26*a*, 27*a* on the free end of the valve shaft 32; whereas, the longer lever ends 26*b* and 27*b* of the valve levers 26 and 27 lie at approximately opposite ends on cam 22.

As shown in FIG. 7, the longer lever end 27*b* crosses the valve lever 26 (viewed in plan) and the pivot pins 35 of the valve levers 26 and 27 lie parallel to each other. Each of the valve levers (26, 27) is pivotally journaled with a bearing section. The rotational axis 36 of the control cam 22 lies approximately in the center between the two pivot axes 35 of the valve levers (26, 27) as shown in FIG. 7.

As shown in FIG. 1, the housing 17 for the cam drive 15 is configured as a housing separate from the crankcase. A common housing wall 13 is provided between the two housings. In the region of the cylinder 2, a cooling channel 37 is provided between the cam drive housing 17 and the cylinder bore. A cooling fluid (air, water) is conducted through the cooling channel 37.

According to the invention, an oil sump 40 is provided in the housing 17 of the cam drive. The sump 40 lies below the crankshaft 6 in the shown normal position of the engine 1. The liquid level 41 of the oil sump 40 preferably lies at a spacing below the crankshaft 6 in the rest position or normal position of the drive engine 1. The crankshaft 6 is provided with suitable seals 38 at both ends in order to prevent oil from exiting from the cam drive housing 17. The oil level 41 is, however, so high that at least a gear wheel of the cam drive 15 at least partially dips into the oil sump 40 in the normal operational position and the position pivoted with respect thereto. In the embodiment shown, this one gear wheel is, for example, the drive gear wheel 14. In this way, oil for lubricating the moveable parts of the engine is pumped.

In the embodiment shown in FIG. 1, the drive gear wheel 14 (and, if required, with the support of the center gear wheel 18) a portion of the oil lifted from the oil sump 40 is misted so that an oil mist occurs above the oil level 41 of the oil sump 40 which fills the cam drive housing 17 and ensures a lubrication of the gear wheel assembly 15 as well as the valve control 23. Above the oil level 41, a lubricating channel 39 branches out from a region 42 of the cam drive housing 17 which has been enriched with the generated oil mist. The lubricating channel 39 opens into the crankcase 11.

In the embodiment of FIG. 1, the lubricating channel 39 is configured as a pipe line which projects with its one end 39*a* into the region 42 filled with oil mist. The entry opening 39*b* of the lubricating channel 39 lies on all sides in spaced relationship to the inner walls of the cam drive housing 17. The other end 39*c* of the lubricating channel 39, which is configured as a line, is connected approximately to the lowest point of the crankcase 11 in the rest position or normal position of the engine 1. The opening of the end 39*c* then lies in a plane with the inner wall of the crankcase 11 so that oil, which deposits on the base 11*a*, can be pumped back via the lubricating channel 39 into the cam drive housing 17.

In the embodiment of FIG. 1, the lubricating channel 39 is configured without a valve. The pumping of the oil mist takes place in correspondence to the arrows 43 exclusively via the fluctuating crankcase pressure so that, with a correspondingly adapted configuration of the line or of the line cross section, oil mist is drawn by suction when there is an underpressure in the crankcase and, when there is overpressure in the crankcase, oil, which has possibly deposited on the base 11*a* or oil mist which is still present, is pumped back into the cam drive housing 17.

Figure 3:
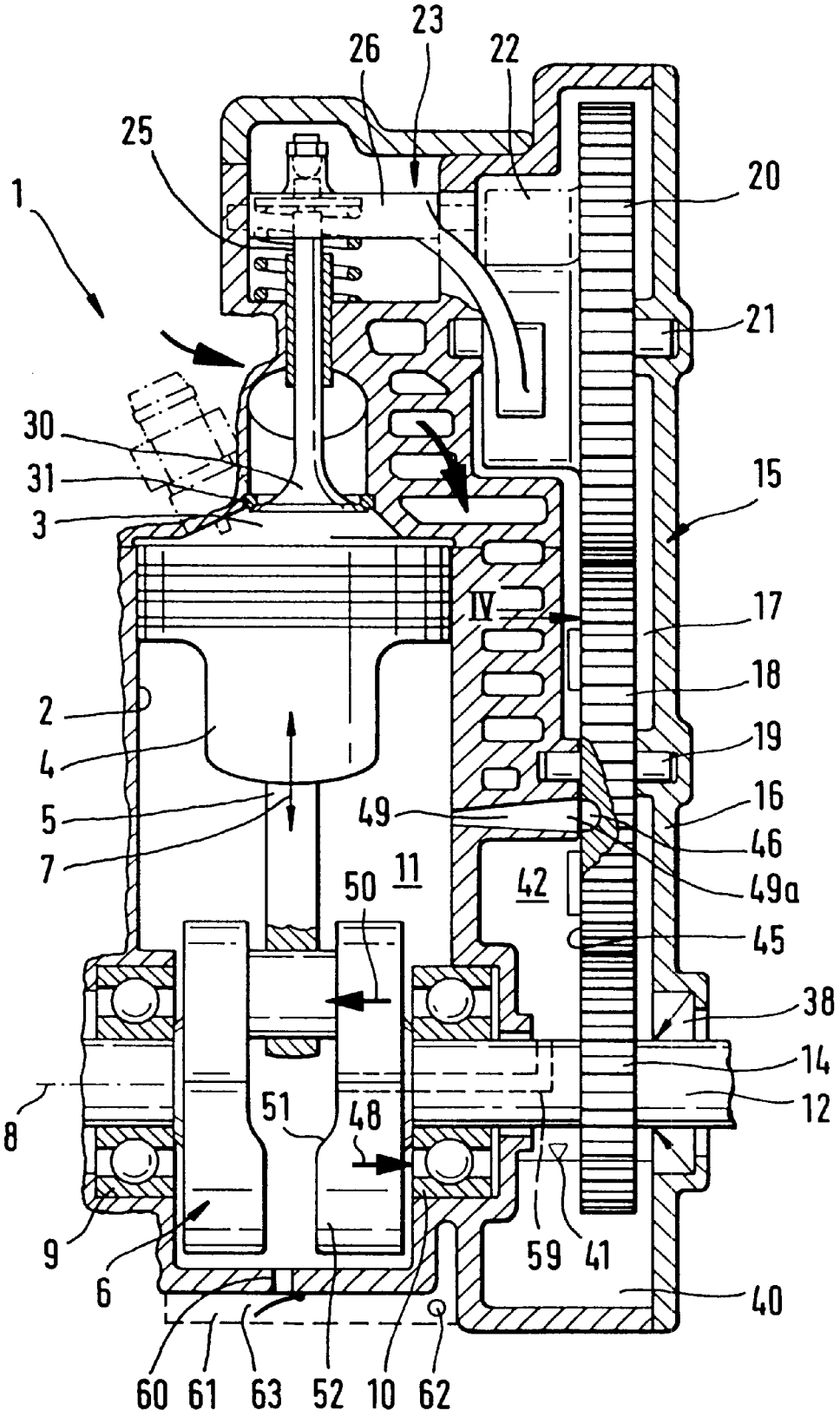
FIG. 3 is a view corresponding to FIG. 1 of an alternate embodiment of the conduction of the lubricating oil.

The embodiment shown in FIG. 3 corresponds basically to the configuration shown in FIG. 1. For this reason, the same reference numerals are used for the same parts. As a departure from the embodiment of FIG. 1, the lubricating channel 49 in FIG. 3 is configured as a bore introduced into the common housing wall 13. This bore is preferably configured so that it is tapered in the direction of the crankcase (FIG. 3). The lubricating channel 49 is force controlled. A type of rotary valve is provided at the end lying in the cam drive housing 17. This rotary cam is controlled in synchronism with the cam drive. The rotary valve is formed on the axial end of the gear wheel 18 of the cam drive 15 facing toward the end 49*a*. In the embodiment shown, the rotary valve is formed on the center gear wheel 18.

Figure 4:
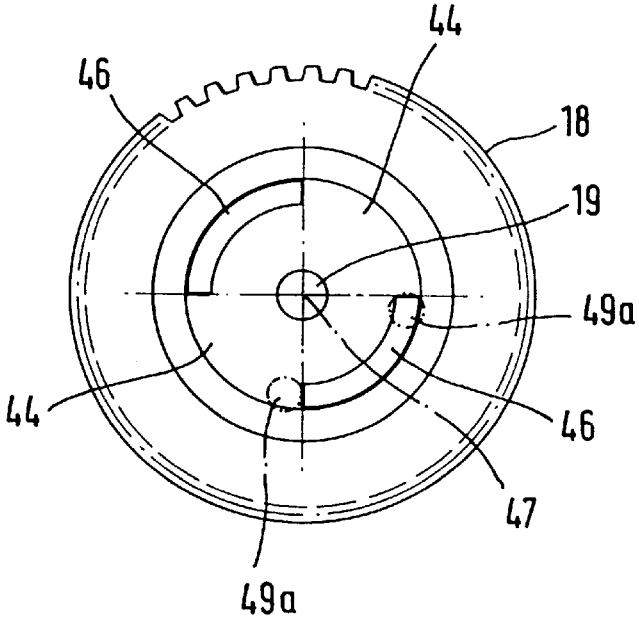
FIG. 4 is a plan view on the axial end face of a toothed wheel as seen in the direction of arrow IV of FIG. 3.

As shown in FIG. 4, the valve member, which is similar to a rotary disc, is formed from an annular region 44 of the facing axial end face 45 of the center gear wheel 18. The annular region 44 joins to the annular slot section 46 in the peripheral direction. As shown in FIG. 4, two diametrically-opposite lying annular regions 44 are provided referred to the rotational axis 47 of the gear wheel 18. These annular regions 44 are separated from each other by the annular slot regions 46. In the embodiment of FIG. 4, the annular regions 44 and the annular slot regions 46 have the same peripheral angles. The peripheral angles are 90° in the embodiment of FIG. 4.

The lubricating channel 49 is therefore opened each time in dependence upon the crankshaft position when the annular slot sections 46 lie in front of the end 49*a* of the lubricating channel 49. If the annular regions 44 lie in front of the end 49*a* of the bore, then the lubricating channel 49 is closed.

The oil deposited in the crankcase 11 is pumped back via a runoff opening 60 in the base 11*a* when there is overpressure in the crankcase. An intermediate space 61 having a return opening 62 to the cam drive housing 17 is advantageous. The runoff opening 60 is controlled by a check valve 63 which is open when there is normal or overpressure.

It can be purposeful to provide the lubricating channel between the cam drive housing 17 and the crankcase 11 via constructively provided gaps in the region of the crankshaft bearing 10. The crankshaft bearing 10 is configured as a roller bearing in the embodiment shown and can be self sealing. If the seal 38 is omitted, then a flow through the bearing 10 in the direction of arrow 48 toward the cam drive housing 17 can occur when there is overpressure in the crankcase 11. For underpressure in the crankcase 11, oil mist is drawn by suction from the oil sump 40 through the bearing 10 from the cam drive housing 17. This oil mist can also include larger oil droplets.

In a further embodiment shown in phantom outline in FIG. 3, the lubricating channel 59 can be configured as a bore in the crankshaft 6. Preferably, the bore 59 opens on the axial end 51 of a crank web 52 so that oil, which enters also directly into the lubricating channel 59, is distributed on the end face 51 of the crankshaft 52 because of the rotating crankshaft 6 and is misted by the centrifugal forces. This type of oil mist generation can be provided additionally to the oil mist generation in the cam drive housing 17. It can also be sufficient to provide the oil mist atomization by exiting on the axial end face 51 of a crank web 52. In this case, the cam drive 15 can be configured as a gear wheel pump which pumps the oil through the bore of the lubricating channel 59 into the crankcase 11. The gear wheels (14, 18, 20) of the cam drive are then utilized as a gear wheel pump as schematically shown in FIG. 2 with the pairing of the gear wheels 14/18.

A direct pumping of the oil to the lubricating locations is advantageous for a configuration of the cam drive 15 as a gear wheel pump. Accordingly, a pumping of the oil from the oil sump to the valve drive 23 is possible in every position of the engine. This is so because an oil sump is formed for each of the gear wheels in every position of the engine as a consequence of the housing walls lying close around the gear wheels and, insofar as one of the gear wheels runs at least partially in the oil and entrains the oil in the peripheral direction and transmits the oil to the next gear wheel. It is therefore advantageously provided that the cam drive housing is configured with a slight spacing to the gear wheels as shown, for example, with the partial circular-shaped configuration in the view of the housing cover 16.

Figure 5:
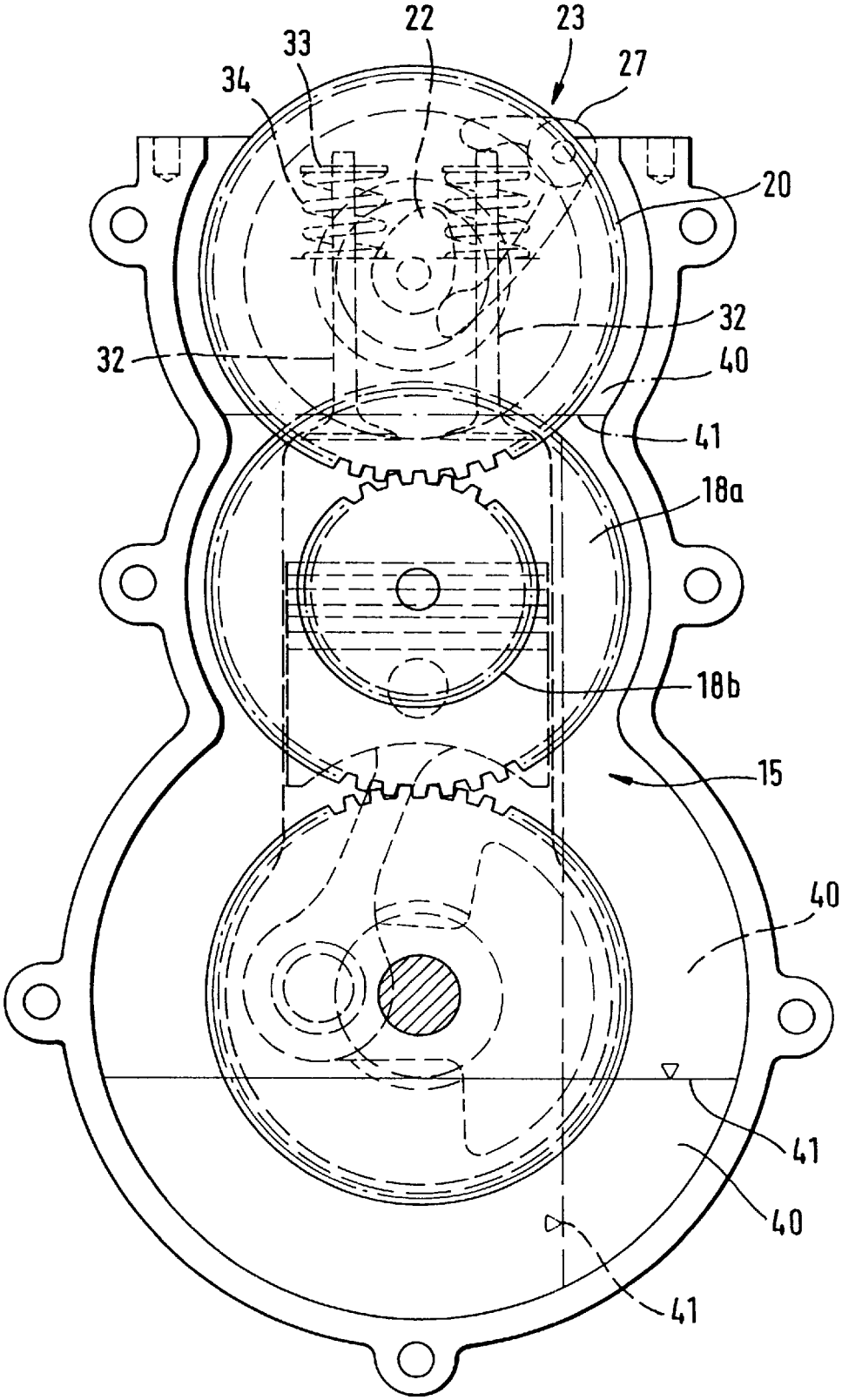
FIG. 5 is a schematic representation of a cam drive.
Figure 6:
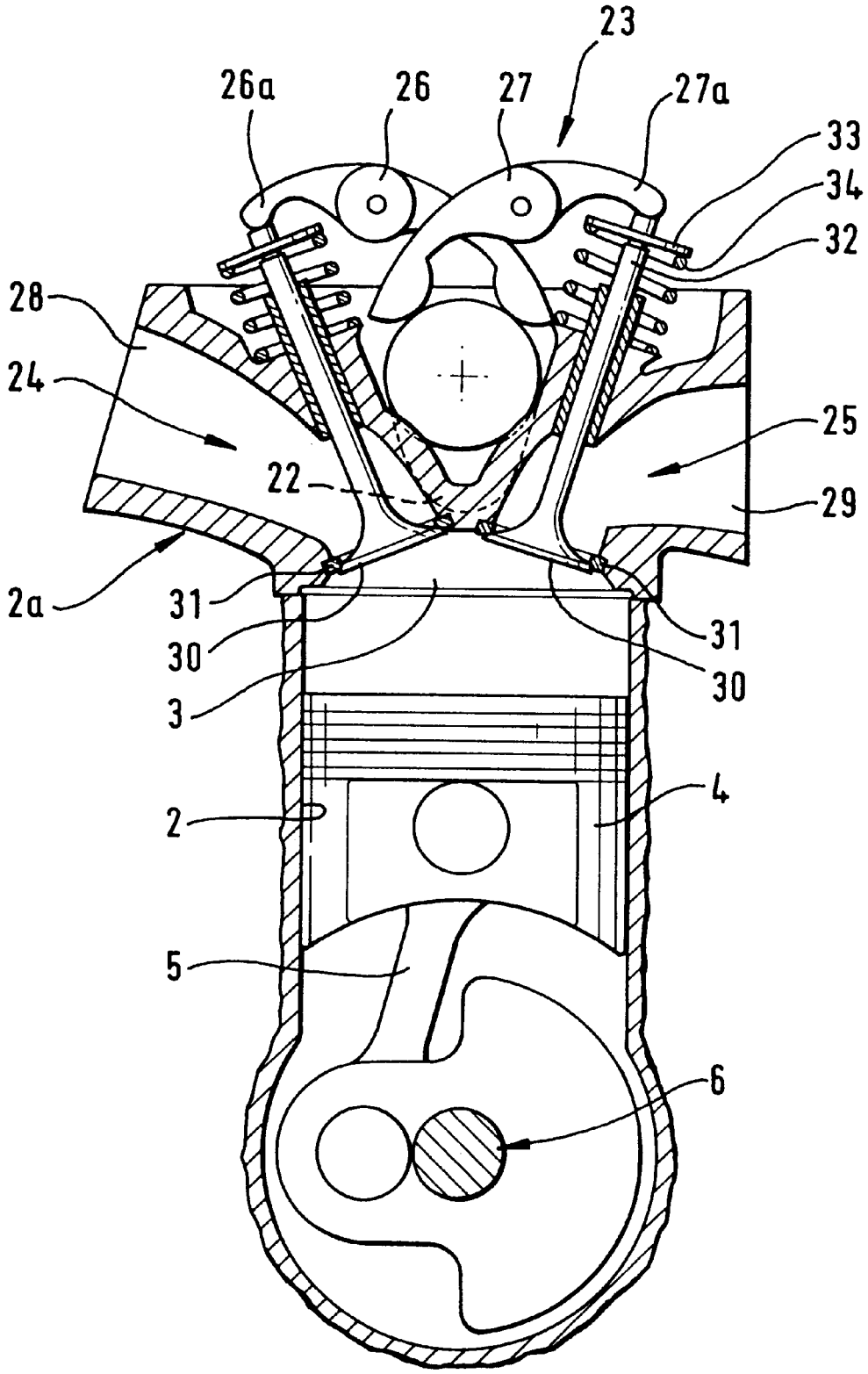
FIG. 6 is a schematic representation of a section through valves arranged in the cylinder head; and, FIG. 7 is a schematic plan view of the valve lever as viewed in the direction of arrow VII of FIG. 6.

In the embodiment of FIG. 5, the valve shafts 32 are arranged parallel to each other. This makes possible a compact configuration. The valve levers (26, 27) are configured with the same configuration as in the embodiments of FIG. 6 and 7 and are again Z-shaped.

In FIG. 5, the cam drive 15, which comprises gear wheels, is so configured that the center gear wheel has two gear teeth sections. Each gear tooth section (18*a*, 18*b*) meshes with a gear wheel (14 or 20). Preferably, the center gear wheel is configured as a double gear wheel having different gear wheel diameters which opens up configuration possibilities for the valve control in a simple manner.

It is understood that the foregoing description is that of the preferred embodiments of the invention and that various changes and modifications may be made thereto without departing from the spirit and scope of the invention as defined in the appended claims.

What is claimed is:

1. An internal combustion engine for a portable handheld work apparatus, said internal combustion engine comprising:

an engine housing including a cylinder and a crankcase;

a piston disposed in said cylinder so as to be movable upwardly and downwardly;

said cylinder defining a combustion chamber delimited by said piston;

said engine housing including an overflow channel leading from said crankcase into said combustion chamber and an outlet channel branching off of said combustion chamber;

a crankshaft rotatably journalled in said crankcase;

a connecting rod interconnecting said piston and said crankshaft so as to permit said piston to rotate said crankshaft;

an inlet valve for controlling said overflow channel and an outlet valve for controlling said outlet channel;

a valve control for controlling the opening and closing of said inlet and outlet valves;

a cam drive housing separate from said crankcase and defining an oil sump containing lubricating oil;

a cam drive for driving said valve control and said cam drive being a gear-wheel drive mounted in said cam drive housing; and, said gear-wheel drive including a plurality of gear wheels and at least one of said gear wheels being mounted in said cam drive housing so as to at least partially dip into said oil sump thereby moving oil to lubricate said cam drive as well as the movable parts of said engine including said valve control.

2. The internal combustion engine of claim 1, said oil in said sump defining an oil level and said one gear wheels causing at least a portion of said oil to form a mist thereby filling a region of said cam drive housing above said oil level with oil mist; and, said engine further comprising a lubrication channel branching away from said region of said cam drive housing above said oil level and opening into said crankcase.

3. The internal combustion engine of claim 2, said lubrication channel being a line which projects into said region of said cam drive housing.

4. The internal combustion engine of claim 3, said crankcase having a lowest point in the rest position of said engine and said line being connected to said crankcase at said lowest point.

5. The internal combustion engine of claim 2, said lubrication channel being formed as a bore in said crankshaft.

6. The internal combustion engine of claim 5, said crankshaft having a crank web and said bore opening on the axial end of said crank web.

7. The internal combustion engine of claim 2, said crankcase and said cam drive housing conjointly defining a common wall.

8. The internal combustion engine of claim 7, said lubrication channel being provided in said common wall.

9. The internal combustion engine of claim 2, said crankcase and said cam drive housing conjointly defining a common wall; and, said engine further comprising crankshaft bearings for rotatably journalling said crankshaft in said crankcase and one of said crankshaft bearings being mounted in said common wall; and, said one crankshaft bearing defining a gap between said crankcase and said cam drive housing and said gap defining said lubrication channel.

10. The internal combustion engine of claim 9, further comprising control means for controlling said lubrication channel.

11. The internal combustion engine of claim 10, said lubrication channel having an end disposed in said cam drive housing and said contol means being adapted to control said lubrication channel at said end thereof.

12. The internal combustion engine of claim 11, said control means including a valve member coacting with said end of said lubrication channel; and, said valve member being operatively connected to said cam drive so as to cause said cam drive to move said valve member.

13. The internal combustion engine of claim 12, said valve member being configured as a rotating slide.

14. The internal combustion engine of claim 13, said rotating slide being defined by one of the gear wheels of said gear-wheel drive.

15. The internal combustion engine of claim 14, said rotating slide being formed from an annular region of the axial end face of said one gear wheel; and, said one gear wheel having annular slot segments formed in said end face.

16. The internal combustion engine of claim 2, said lubrication channel being controlled without a valve.

17. The internal combustion engine of claim 2, said gear wheels of said gear-wheel drive being meshed one with the other and being configured as a gear-wheel pump for moving the oil to lubricating locations of said engine.

18. The internal combustion engine of claim 17, said lubrication channel being formed as a bore between said crankcase and said cam drive housing; and, said gear-wheel pump being adapted to pump oil into said bore.

19. The internal combustion engine of claim 18, said bore being formed in said crankshaft.

20. The internal combustion engine of claim 1, said gear-wheel drive comprising three gear wheels.

21. The internal combustion engine of claim 20, said cam drive including a cam; said gear-wheel drive comprising a drive gear wheel on said crankshaft; an output gear wheel corresponding to said cam; and, a center gear wheel in meshing engagement with said drive gear wheel and said output gear wheel.

22. The internal combustion engine of claim 21, said center gear wheel having a first gear meshing with said drive gear wheel and a second gear meshing with said output gear wheel.

23. The internal combustion engine of claim 21, said output gear wheel and said cam being formed as a single piece.

24. The internal combustion engine of claim 21, at least one of said gear wheels being made of plastic.

25. The internal combustion engine of claim 24, said plastic being Nylon or fiber-reinforced plastic.

26. The internal combustion engine of claim 21, said inlet valve and said outlet valve both being controlled by said cam.

27. The internal combustion engine of claim 1, said valves having respective valve stems and said valve stems lying at an angle with respect to each other.

28. The internal combustion engine of claim 1, said valves having respective valve stems and said valve stems lying parallel to each other.

* * * * *